US008366234B2

(12) United States Patent
Ito et al.

(10) Patent No.: US 8,366,234 B2
(45) **Date of Patent: *Feb. 5, 2013**

(54) INKJET RECORDING APPARATUS

(75) Inventors: Kazumasa Ito, Tajimi (JP); Hirotaka Hayashi, Nagoya (JP)

(73) Assignee: Ricoh Elemex Corporation, Nagoya-shi (JP)

( * ) Notice: Subject to any disclaimer, the term of this patent is extended or adjusted under 35 U.S.C. 154(b) by 402 days.

This patent is subject to a terminal disclaimer.

(21) Appl. No.: 12/489,063

(22) Filed: Jun. 22, 2009

(65) Prior Publication Data

US 2009/0322823 A1 Dec. 31, 2009

(30) Foreign Application Priority Data

Jun. 26, 2008 (JP) ..... 2008-167643

(51) Int. Cl.
*B41J 29/393* (2006.01)

(52) U.S. Cl. ..... 347/19; 347/5; 347/14

(58) Field of Classification Search ..... 347/5, 9, 347/14, 19

See application file for complete search history.

(56) References Cited

U.S. PATENT DOCUMENTS

| | | | | |
|---|---|---|---|---|
| 6,325,505 | B1 | 12/2001 | Walker | |
| 6,513,900 | B2 * | 2/2003 | Endo et al. | 347/19 |
| 7,101,013 | B2 | 9/2006 | Nakamura | |
| 2003/0071984 | A1 | 4/2003 | Teramae et al. | |
| 2004/0017443 | A1 | 1/2004 | Ikeda et al. | |
| 2006/0146077 | A1 | 7/2006 | Song et al. | |
| 2011/0227989 | A1 | 9/2011 | Ito et al. | |

FOREIGN PATENT DOCUMENTS

| | | | |
|---|---|---|---|
| EP | 1245397 | A1 | 10/2002 |
| JP | 2002-144597 | A | 5/2002 |
| JP | 3509706 | B2 | 3/2004 |
| JP | 2004-209460 | A | 7/2004 |
| JP | 2007-331158 | A | 12/2007 |

* cited by examiner

*Primary Examiner* — Lam S Nguyen
(74) *Attorney, Agent, or Firm* — Foley & Lardner LLP

(57) ABSTRACT

An ink-droplet detecting unit detects a spray state of an ink droplet sprayed from an ink-droplet spray head. The ink-droplet detecting unit includes a light-emitting element, a light-emitting element holder, a light-receiving element, a light-receiving element holder, and a base member. The light-emitting element holder is attached to the base member in a rotatable manner. The light-receiving element holder is attached to the base member in a slidable manner in a direction perpendicular to a rotation direction of the light-emitting element holder. The ink-droplet detecting unit is attached to a main body of the inkjet recording apparatus.

8 Claims, 8 Drawing Sheets

INKJET RECORDING APPARATUS

CROSS-REFERENCE TO RELATED APPLICATIONS

The present application claims priority to and incorporates by reference the entire contents of Japanese priority document 2008-167643 filed in Japan on Jun. 26, 2008.

BACKGROUND OF THE INVENTION

Field of the Invention

A conventional inkjet recording apparatus, such as a printer, a copier, or a facsimile, employs an inkjet system to form an image on a recording medium such as a sheet. The inkjet recording apparatus includes an ink-droplet spray head that sprays an ink droplet and an ink-droplet detecting unit that detects a spray state of the ink droplet sprayed from the ink-droplet spray head.

For example, such an inkjet recording apparatus including an ink-droplet detecting unit is disclosed in Japanese Patent No. 3509706. The ink-droplet detecting unit includes a light-emitting module and a light-receiving module that are fixed to a base member. An angle of the light-emitting module can be adjusted in the perpendicular direction and the light-receiving module can be adjusted by moving in the lateral direction whereby a light axis is adjusted. An ink droplet is sequentially sprayed from an ink-droplet spray head while the ink-droplet spray head is moved, and a laser light emitted from the light-emitting module strikes a floating ink droplet sprayed from the ink-droplet spray head, so that a spray state of the ink droplet, such as spray failure or spray of an ink droplet at an angle, can be detected based on variation in intensity of light received by the light-receiving module.

However, it is difficult to spray an ink droplet from each nozzle hole included in the ink-droplet spray head to the light axis of the laser light tilted at a tilt angle of 26 degrees with appropriate timing in accordance with movement of the ink-droplet spray head and cause the laser light emitted from the light-emitting module to strike a floating ink droplet unless the ink-droplet detecting unit and a main body of the inkjet recording apparatus are arranged with planar position accuracy. Moreover, when the light axis is adjusted to obtain parallelism between the light axis and a row of nozzle holes, although it is considered that there would not be tilt variation in adjusting the light-emitting module in the perpendicular direction, no consideration has been given on a positional relation between the ink-droplet detecting unit including the light-receiving module and the row of the nozzle holes.

SUMMARY OF THE INVENTION

It is an object of the present invention to at least partially solve the problems in the conventional technology.

According to one aspect of the present invention, there is provided an inkjet recording apparatus including an ink-droplet spray head that sprays an ink droplet and an ink-droplet detecting unit that detects a spray state of the ink droplet. The ink-droplet detecting unit includes a light-emitting element that emits a light, a light-emitting element holder that holds the light-emitting element, a light-receiving element that receives the light emitted from the light-emitting element, a light-receiving element holder that holds the light-receiving element, and a base member on which the light-emitting element holder and the light-receiving element holder are mounted at an emission-side positioning point and a reception-side positioning point, respectively. The light-emitting element holder is attached to the base member in a rotatable manner around the emission-side positioning point. The light-receiving element holder is attached to the base member in a slidable manner in a direction perpendicular to a rotation direction of the light-emitting element holder. The ink-droplet detecting unit is attached to a main body of the inkjet recording apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1A:
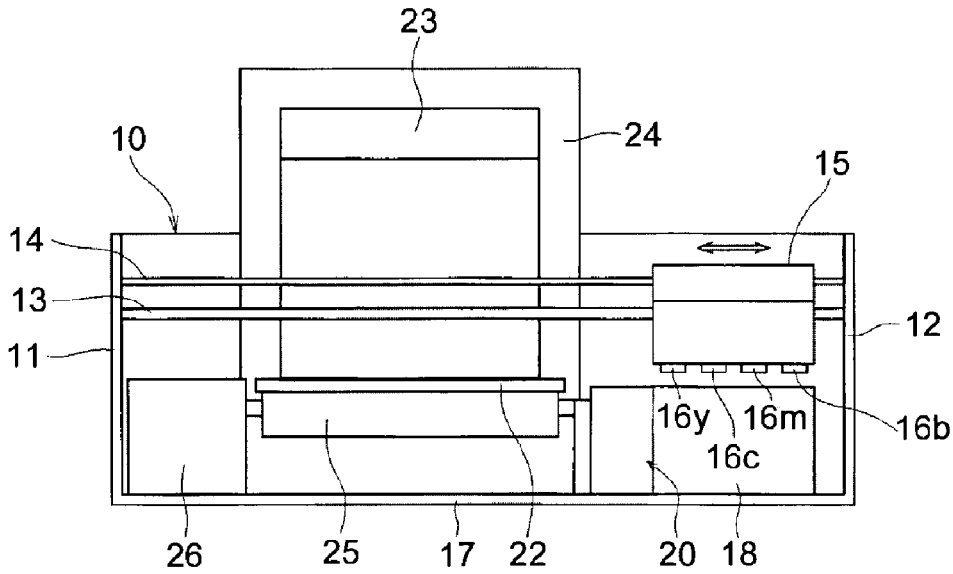
FIG. 1A is a front view of an inkjet printer including an ink-droplet detecting unit according to an embodiment of the present invention.
Figure 1B:
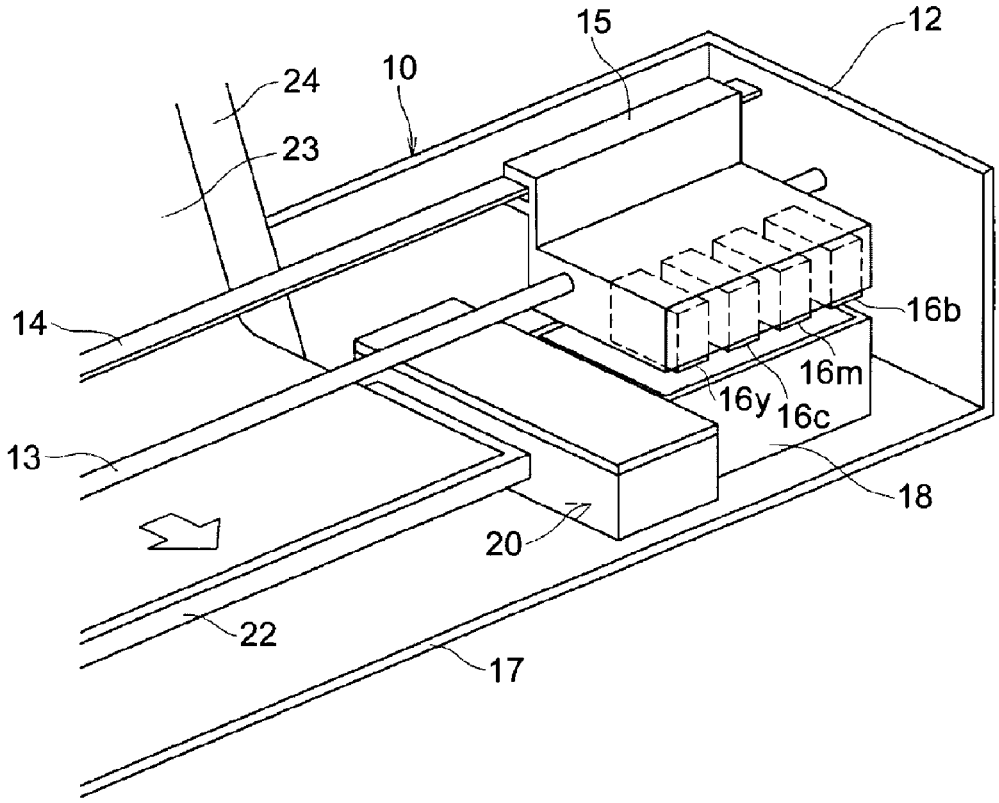
FIG. 1B is a perspective view of a part of the inkjet printer.

FIG. 1A is a front view of an inkjet printer including an ink-droplet detecting unit 20 according to an embodiment of the present invention, and FIG. 1B is a perspective view of a part of the inkjet printer.

The inkjet printer includes a casing 10. Side plates 11 and 12 are arranged on both sides of the casing 10, and a guide shaft 13 and a guide plate 14 are arranged between the side plates 11 and 12 in parallel to each other. A carriage 15 is supported by the guide shaft 13 and the guide plate 14. An endless belt (not shown) is attached to the carriage 15. The endless belt is supported by a drive pulley (not shown) and a driven pulley (not shown) that are arranged on both sides of the casing 10. The driven pulley is rotated to move the endless belt with the rotation of the drive pulley, so that the carriage 15 is movable in the lateral direction indicated by a two-headed arrow shown in FIG. 1A.

The carriage 15 includes ink-droplet spray heads 16*y*, 16*c*, 16*m*, and 16*b* (hereinafter, simply referred to as "ink-droplet spray head 16" as appropriate) corresponding to four colors of yellow, cyan, magenta, and black. The ink-droplet spray heads 16*y*, 16*c*, 16*m*, and 16*b* are arranged in a direction along which the carriage 15 is movable. Each of the ink-droplet spray heads 16*y*, 16*c*, 16*m*, and 16*b* includes a row of nozzle holes that are linearly arranged on a downward-facing nozzle surface. Although not shown, for example, two rows of the nozzle holes are arranged in a direction perpendicular to the direction along which the carriage 15 is movable.

When the carriage 15 is located at a home position on the extreme right of the casing 10 as shown in FIG. 1A, each of the ink-droplet spray heads 16*y*, 16*c*, 16*m*, and 16*b* is opposed to an independent restoration device 18 mounted on a bottom plate 17 of the casing 10. The independent restoration device 18 enables the inkjet printer itself to independently restore spray failure of an ink droplet by sucking out ink from the nozzle hole in which the spray failure is detected by the ink-droplet detecting unit 20.

The ink-droplet detecting unit 20 is mounted adjacent to the independent restoration device 18 such that the longitudinal side of the ink-droplet detecting unit 20 is arranged in a direction perpendicular to the moving direction of the carriage 15 on the bottom plate 17. The ink-droplet detecting unit 20 will be explained in detail later with reference to FIG. 2 and subsequent figures.

A plate-shaped platen 22 is arranged adjacent to the ink-droplet detecting unit 20. A feed board 24 is arranged at a tilt on the rear side of the platen 22. The feed board 24 feeds a recording medium 23 such as a sheet to the platen 22. Although not shown, a feed roller is arranged to feed the recording medium 23 from the feed board 24 to the platen 22. Furthermore, a conveying roller 25 is arranged to convey the recording medium 23 from the platen 22 in a direction indicated by an arrow shown in FIG. 1B thereby discharging the recording medium 23 to the front side of the inkjet printer.

A drive device 26 is arranged on the extreme left of the bottom plate 17 as shown in FIG. 1A. The drive device 26 drives the feed roller, the conveying roller 25, and the like, as well as the drive pulley to drive the endless belt thereby moving the carriage 15.

When an image forming operation is performed, the drive device 26 causes the recording medium 23 to be conveyed to the platen 22 whereby the recording medium 23 is set at a predetermined position, and causes the carriage 15 to be moved above the recording medium 23 leftward in FIG. 1A while the ink-droplet spray heads 16*y*, 16*c*, 16*m*, and 16*b* sequentially spray ink droplets from the nozzle holes, so that an image is formed on the recording medium 23. After the image is formed on the recording medium 23, the carriage 15 is moved back rightward in FIG. 1A, while the recording medium 23 is conveyed by a predetermined distance in the direction indicated by the arrow in FIG. 1B.

The carriage 15 is then moved leftward in FIG. 1A again, while the ink-droplet spray heads 16*y*, 16*c*, 16*m*, and 16*b* sequentially spray ink droplets from the nozzle holes, so that an image is formed on the recording medium 23. After the image is formed on the recording medium 23, the carriage 15 is moved back rightward in FIG. 1A, while the recording medium 23 is conveyed by a predetermined distance in the direction indicated by the arrow in FIG. 1B. The above process is repeated so that the entire image is formed on the recording medium 23.

Figure 2:
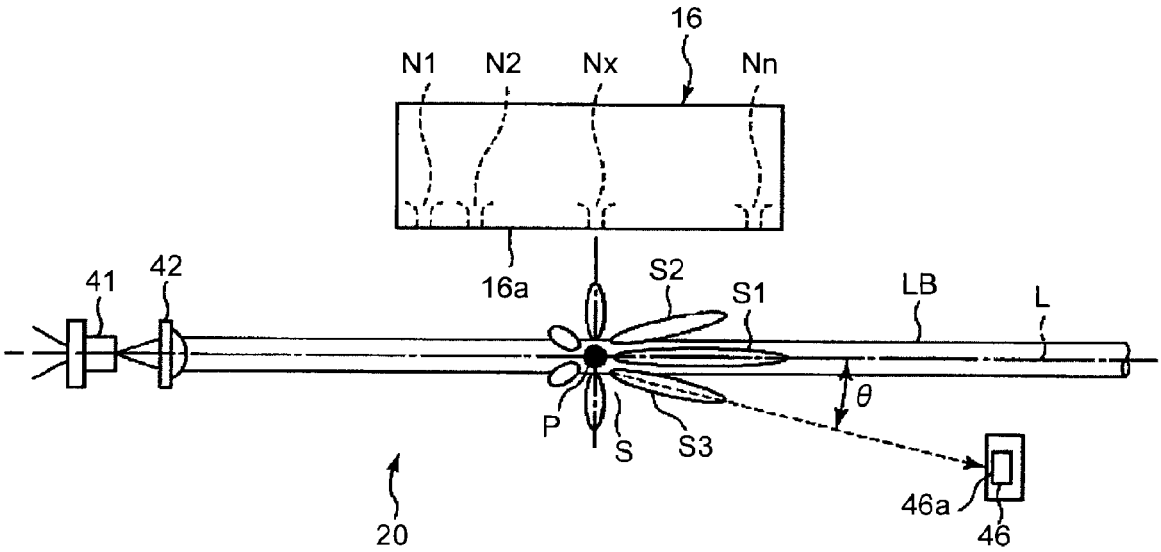
FIG. 2 is a schematic diagram of the ink-droplet detecting unit and an ink-droplet spray head included in the inkjet printer.

FIG. 2 is a schematic diagram of the ink-droplet detecting unit 20 and the ink-droplet spray head 16.

The ink-droplet spray head 16 includes a downward-facing head nozzle surface 16*a*. A row of linearly arranged nozzle holes N1, N2, . . . , Nx, . . . and Nn is formed on the head nozzle surface 16*a*. Each of the nozzle holes N1, N2, . . . , Nx, . . . and Nn selectively sprays an ink droplet P as a liquid droplet.

The ink-droplet detecting unit 20 detects spray failure of the ink droplet P sprayed from each of the nozzle holes N1, N2, . . . , Nx, . . . and Nn. The ink-droplet detecting unit 20 includes a light-emitting element 41 that emits a light, a collimating lens 42 that collimates the light emitted from the light-emitting element 41 thereby forming a light beam LB, and a light-receiving element 46 such as a photodiode that receives the light emitted from the light-emitting element 41.

The ink-droplet detecting unit 20 is arranged in a direction intersecting a spray direction of the ink droplet P such that the light beam LB strikes the floating ink droplet P sprayed from the head nozzle surface 16*a* and such that a light axis L of the light beam LB is located in parallel to the row of the nozzle holes N1, N2, . . . , Nx, . . . and Nn at a position away from the head nozzle surface 16*a* by a certain distance.

The light-receiving element 46 is arranged at a position lower than the light beam LB with an angle θ from the light axis L so that an light-receiving surface 46*a* included in the light-receiving element 46 is located outside of a beam diameter of the light beam LB having an elliptical shape on cross section.

The ink droplet P is sprayed from the nozzle hole Nx, and then the light beam LB strikes the ink droplet P whereby scattered lights S including scattered lights S1, S2, and S3 are generated. The scattered light S3 is received by the light-receiving surface 46*a*, and output of the light-receiving element 46 is measured as a voltage value (light output value), so that data on the received light is obtained. It is detected whether the ink droplet P is sprayed or whether there is liquid spray failure such that the ink droplet P is sprayed at an angle based on variation in output of the light-receiving element 46.

Figure 3:
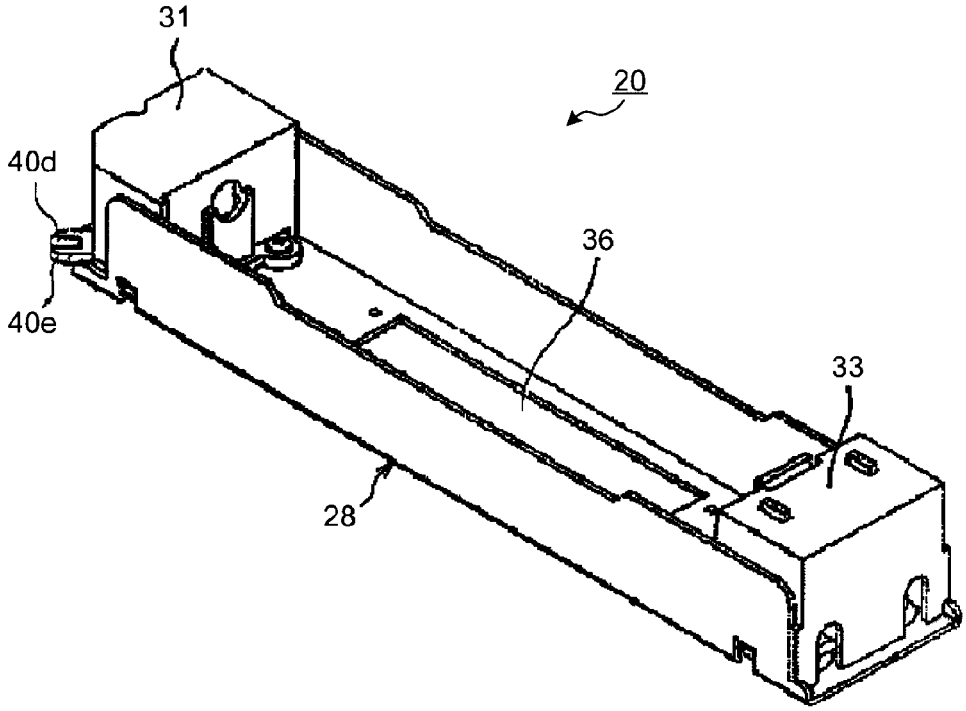
FIG. 3 is a perspective view of the ink-droplet detecting unit.
Figure 4:
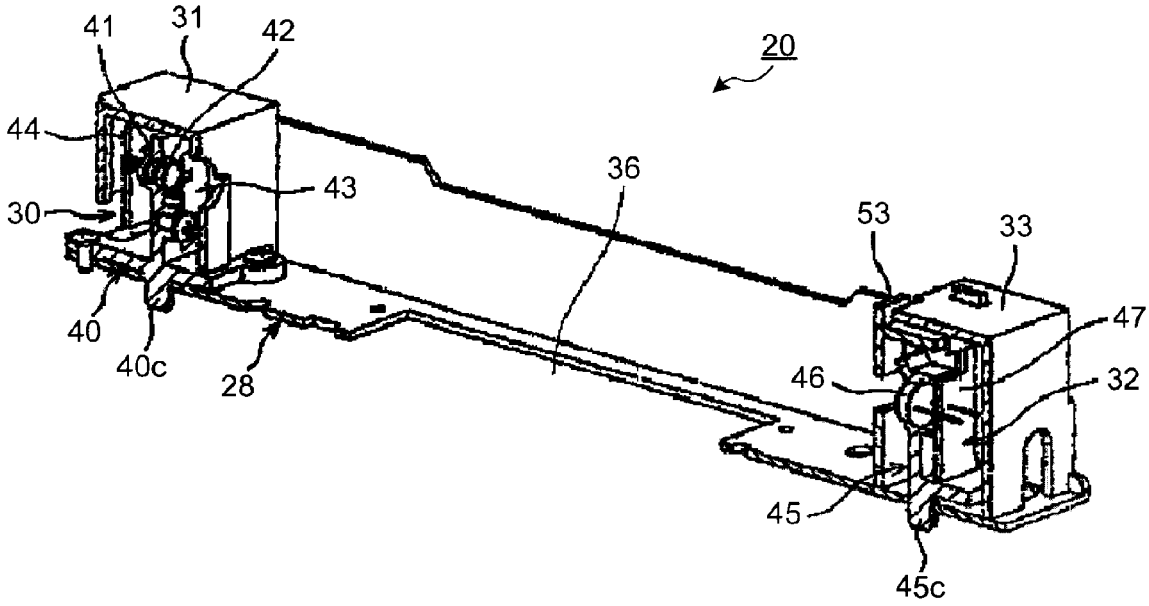
FIG. 4 is a cross-sectional view of the ink-droplet detecting unit in the longitudinal direction.

FIG. 3 is a perspective view of the ink-droplet detecting unit 20, and FIG. 4 is a cross-sectional view of the ink-droplet detecting unit 20 in the longitudinal direction.

The ink-droplet detecting unit 20 includes a base member 28 having a U-shape on longitudinal cross section such that the base member 28 is formed by folding a long narrow plate on both sides in the longitudinal direction. A light-emitting module 30 is arranged on one end of the base member 28 in the longitudinal direction and is covered with an emission-side module cover 31. A light-receiving module 32 is arranged on the other end of the base member 28 in the longitudinal direction and is covered with a reception-side module cover 33.

Figure 5:
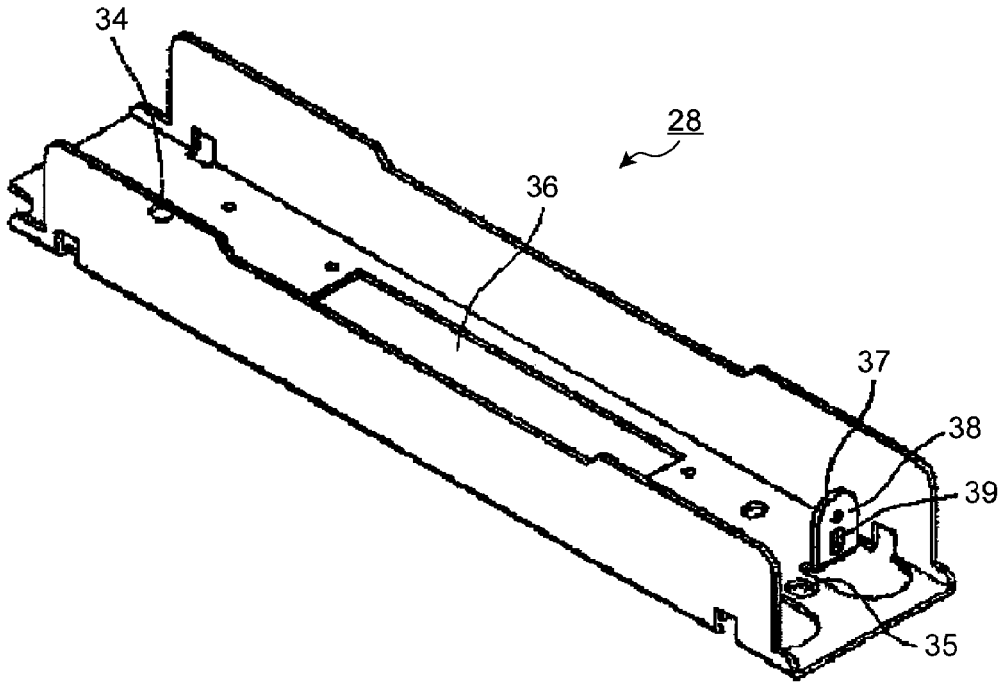
FIG. 5 is a perspective view of a base member shown in FIG. 3.

FIG. 5 is a perspective view of the base member 28.

The base member 28 includes an emission-side positioning hole 34 having a circular shape arranged on the emission side where the light-emitting module 30 is arranged and a reception-side positioning hole 35 having a long oval shape extending toward the emission side arranged on the reception side where the light-receiving module 32 is arranged. An opening 36 having a long narrow rectangle shape is formed on the base member 28 between the emission-side positioning hole 34 and the reception-side positioning hole 35 in the longitudinal direction. Two cut and folded portions 37 are formed on both sides of the reception-side positioning hole 35 in the width direction of the base member 28 such that portions of the base member 28 are cut and folded over along fold lines extending in the width direction. A guide surface 38 is formed on the outer surface of the cut and folded portion 37, and a guide groove 39 is arranged on the cut and folded portion 37 in the longitudinal direction.

Figure 6:
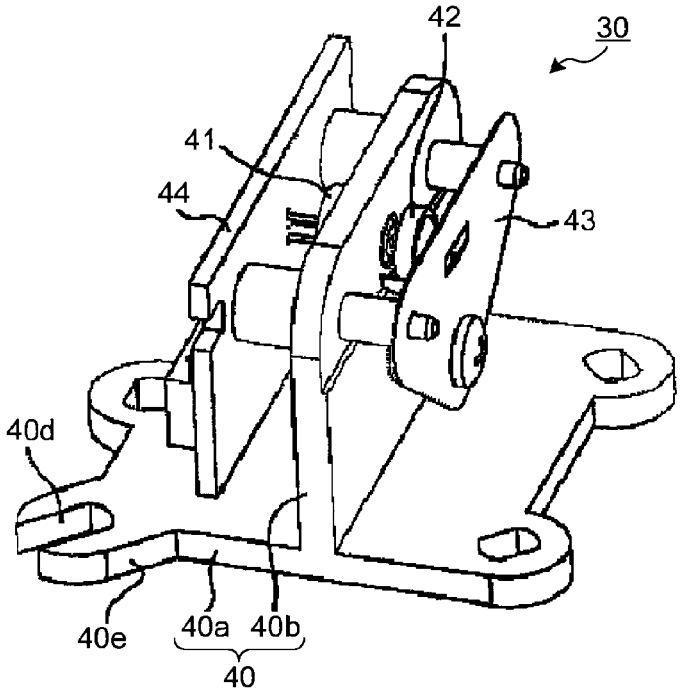
FIG. 6 is a perspective view of a light-emitting module shown in FIG. 4.

FIG. 6 is a perspective view of the light-emitting module 30.

The light-emitting module 30 includes a light-emitting element holder 40, the light-emitting element 41, the collimating lens 42, an aperture 43, and a circuit board 44. The light-emitting element holder 40 includes a square bottom plate 40*a* and a longitudinal plate 40*b* that is protruded in the perpendicular direction at the middle of the bottom plate 40*a*. The light-emitting element holder 40 has an inverted T-shape in three dimensions. The bottom plate 40*a* includes an emission-side holder shaft 40*c* (see FIGS. 4 and 9) protruded downward from the center of the bottom surface of the bottom plate 40*a* and a protruded portion 40*e* arranged at one corner of the bottom plate 40*a*. The protruded portion 40*e* includes a groove-like jig engagement portion 40*d* extending in a direction along a diagonal of the bottom plate 40*a*. The light-emitting element 41, the collimating lens 42, the aperture 43, and the circuit board 44 are attached to the longitudinal plate 40*b*.

Figure 7:
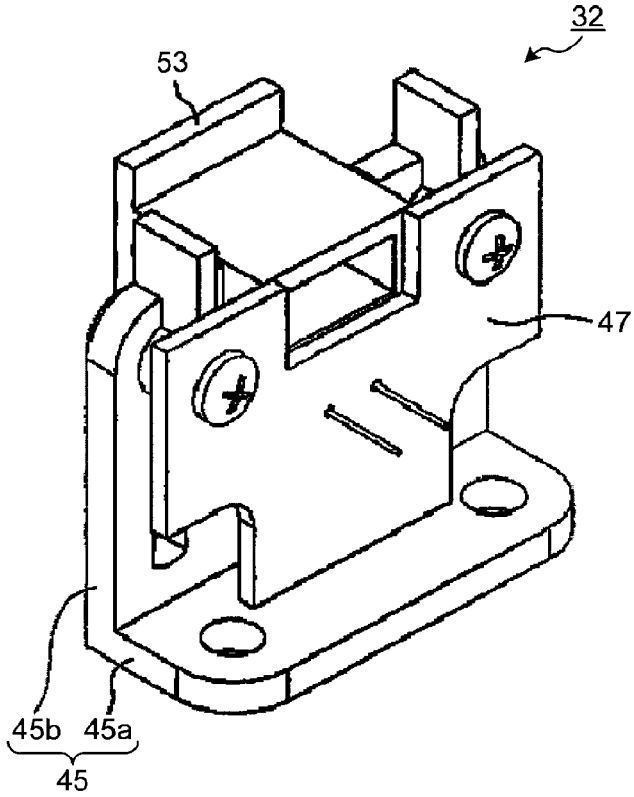
FIG. 7 is a perspective view of a light-receiving module shown in FIG. 4.

FIG. 7 is a perspective view of the light-receiving module 32.

The light-receiving module 32 includes a light-receiving element holder 45, the light-receiving element 46 (see FIG. 4), and a circuit board 47. The light-receiving element 46, the circuit board 47, and the like, are attached to the light-receiving element holder 45. The light-receiving element holder 45 includes a bottom plate 45*a* having a shape like a long narrow plate and a longitudinal plate 45*b* arranged in the perpendicular direction on a longitudinal side edge of the bottom plate 45*a*. The light-receiving element holder 45 has an L-shape in three dimensions. The bottom plate 45*a* includes a reception-side holder shaft 45*c* protruded downward from the bottom surface of the bottom plate 45*a* (see FIGS. 4, 9, and 10). The light-receiving element 46, the circuit board 47, and the like, are attached to the longitudinal plate 45*b*. A slide surface 45*d* is formed on the surface of the longitudinal plate 45*b* opposed to the emission side in parallel to a shaft center of the reception-side holder shaft 45*c*, and a guide protrusion 45*e* is formed on the slide surface 45*d* (see FIGS. 9 and 10).

Figure 8:
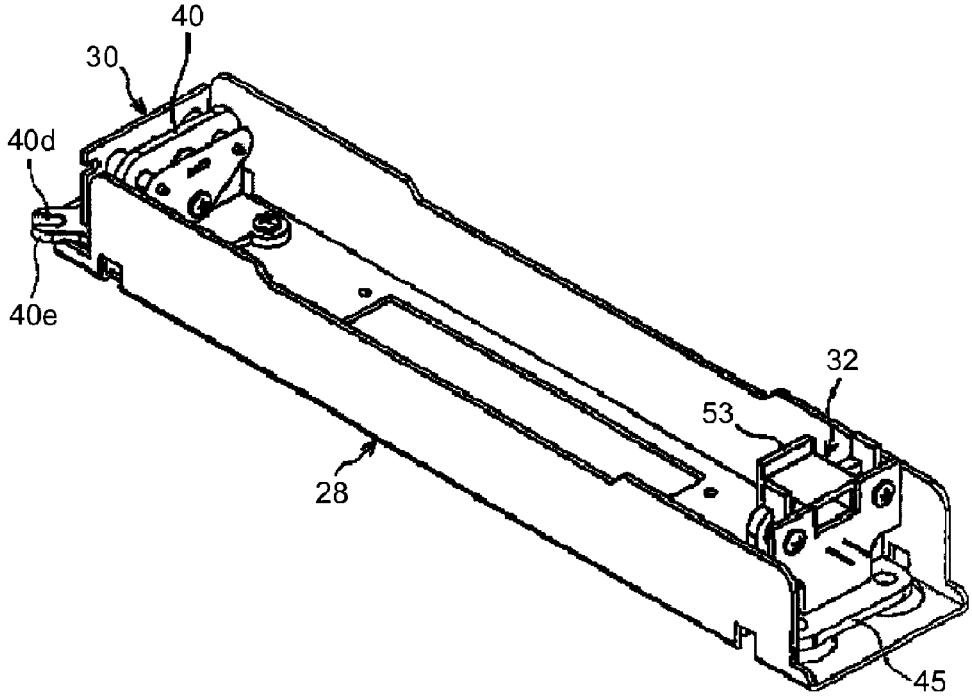
FIG. 8 is a schematic diagram of the base member to which the light-emitting module and the light-receiving module are attached.
Figure 9:
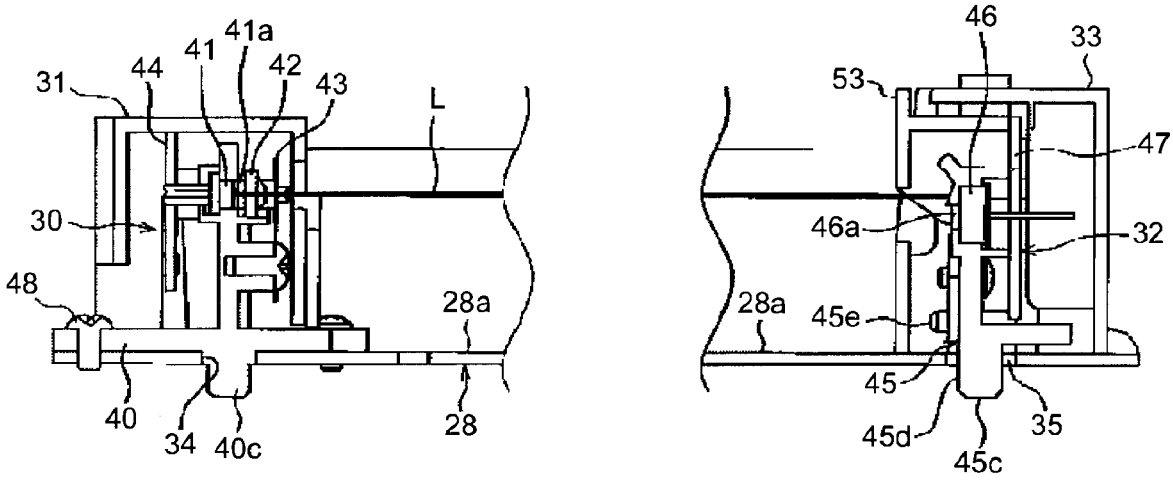
FIG. 9 is an enlarged longitudinal sectional view of areas where the light-emitting module and the light-receiving module are mounted.

FIG. 8 is a schematic diagram of the base member 28 to which the light-emitting module 30 and the light-receiving module 32 are attached. FIG. 9 is an enlarged longitudinal sectional view of areas where the light-emitting module 30 and the light-receiving module 32 are mounted.

The light-emitting module 30 is mounted on a receiving surface 28*a* of the base member 28 such that the emission-side holder shaft 40*c* is inserted into the emission-side positioning hole 34, so that the light-emitting element holder 40 is rotatably attached to the base member 28 in an adjustable manner. After the light-emitting module 30 is rotated for adjustment, the light-emitting module 30 is fixed to the base member 28 with a plurality of fastening members 48. The light-emitting element 41 is arranged in parallel to the receiving surface 28*a* and the collimating lens 42 is fixedly mounted on the light axis L of the light beam LB emitted from the light-emitting element 41 after focus adjustment whereby a desired beam diameter can be obtained. Furthermore, the aperture 43 is arranged in front of the collimating lens 42 to eliminate flare of the light beam LB. The light-receiving module 32 is mounted on the receiving surface 28*a* such that the reception-side holder shaft 45*c* is inserted into the reception-side positioning hole 35, so that the light-receiving element holder 45 is slidably attached to the base member 28 in the perpendicular direction in an adjustable manner. The light-emitting module 30 and the light-receiving module 32 are covered with the emission-side module cover 31 and the reception-side module cover 33, respectively.

An emission point 41*a* of the light-emitting element 41 is located at a position corresponding to the shaft center of the emission-side holder shaft 40*c*. Thus, the light-emitting element holder 40 can be rotated around the emission point 41*a* of the light beam LB, so that it is possible to minimize misalignment of the emission point 41*a* and adjust an angle of the light axis L in consideration of position accuracy. Furthermore, the shaft center of the reception-side holder shaft 45*c* is arranged in parallel to the light-receiving surface 46*a*. Thus, the light-receiving element holder 45 can be moved in the perpendicular direction and fastened to the base member 28 such that the light axis L coincides with the center of the light-receiving element 46.

Figure 10:
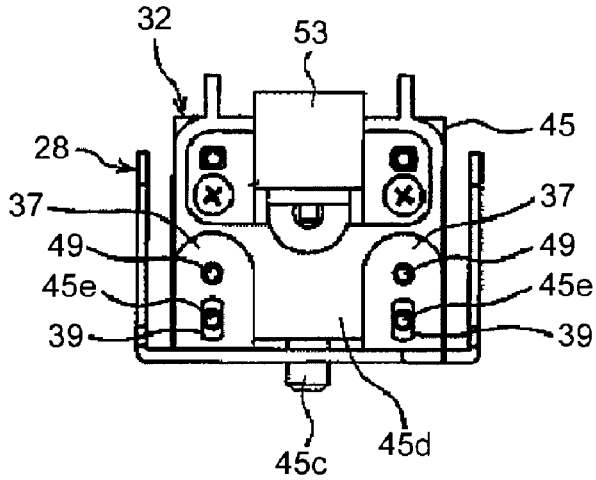
FIG. 10 is a schematic diagram of the light-receiving module attached to the base member as seen from the side of the light-emitting module.

FIG. 10 is a schematic diagram of the light-receiving module 32 attached to the base member 28 as seen from the side of the light-emitting module 30.

The guide protrusion 45*e* is inserted into the guide groove 39, and the slide surface 45*d* is brought into contact with the guide surface 38 so that the light-receiving element holder 45 is guided by the guide surface 38 for movement. After the light-receiving module 32 is slid for adjustment in the perpendicular direction, the light-receiving module 32 is fixed to the base member 28 with a plurality of fastening members 49.

Figure 11:
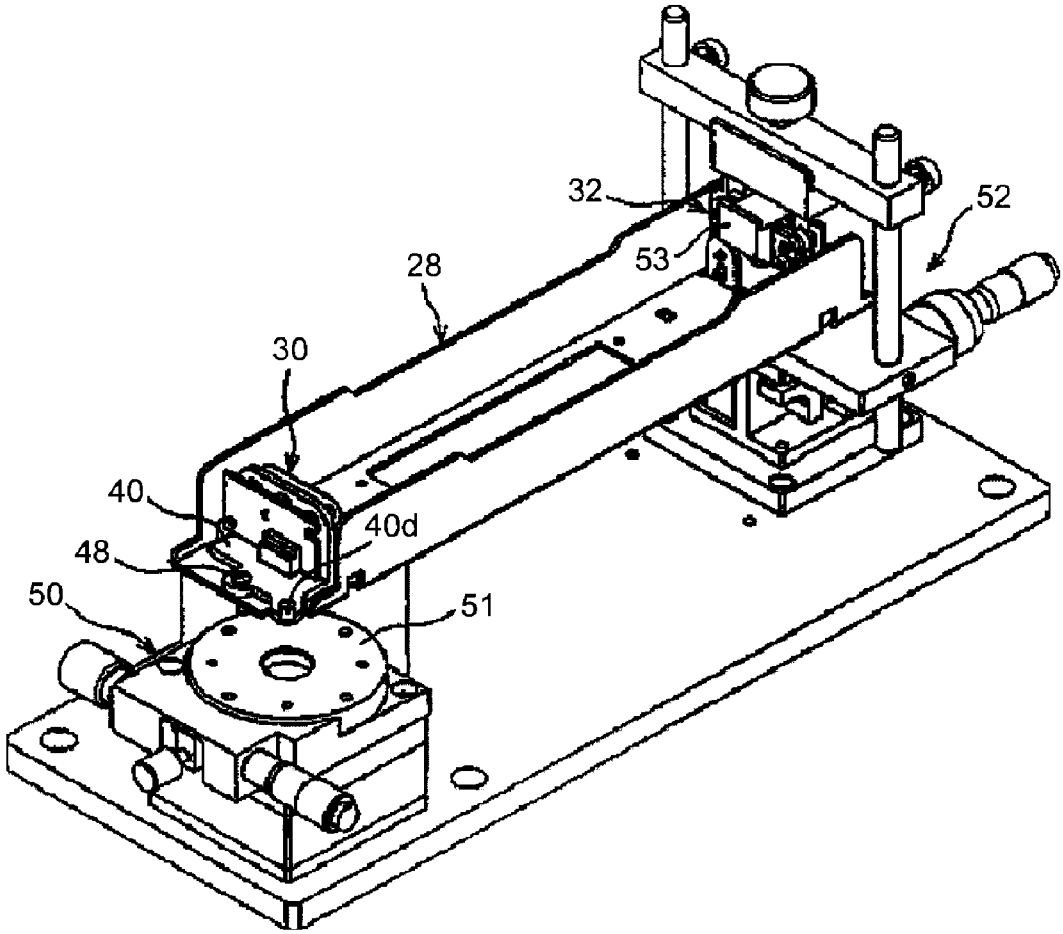
FIG. 11 is a perspective view of the light-emitting module and the light-receiving module attached to the base member.

FIG. 11 is a perspective view of the light-emitting module 30 and the light-receiving module 32 attached to the base member 28.

Although it is shown in FIG. 11 that the emission-side module cover 31 and the reception-side module cover 33 are removed from the light-emitting module 30 and the light-receiving module 32, respectively, the light-emitting module 30 and the light-receiving module 32 can be adjusted with the emission-side module cover 31 and the reception-side module cover 33. For example, a through-hole used for a fastening member included in the light-emitting element holder 40 and the jig engagement portion 40*d* are exposed through the emission-side module cover 31. A part of a rotary adjustment jig 50 is engaged with the jig engagement portion 40*d* and a rotary member included in the rotary adjustment jig 50 is rotated whereby the light-emitting element holder 40 is rotated for adjustment around the emission-side holder shaft 40*c* inserted into the emission-side positioning hole 34, so that the light beam LB emitted from the light-emitting element 41 can be rotated in the horizontal direction. After the adjustment is performed, the light-emitting module 30 is fixed to the base member 28 with the fastening member 48 inserted into the through-hole.

Figure 12:
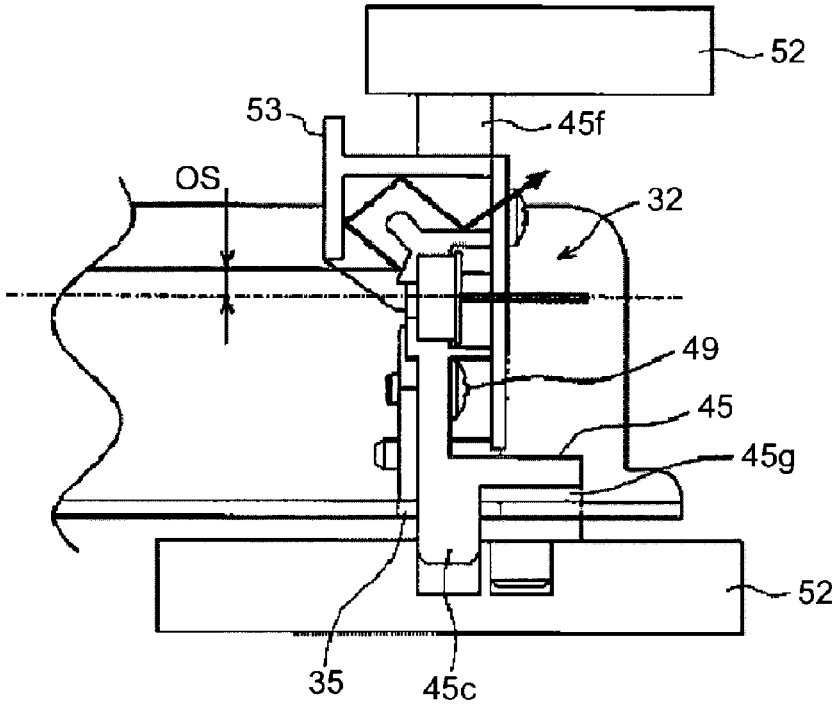
FIG. 12 is a schematic diagram for explaining adjustment of the attached light-receiving module as seen from a direction perpendicular to a direction of a light beam emitted from a light-emitting element shown in FIG. 2.
Figure 13:
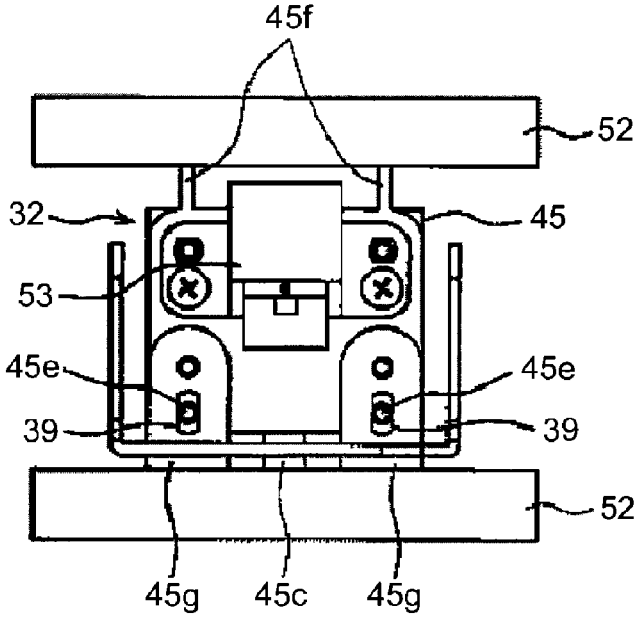
FIG. 13 is a schematic diagram for explaining adjustment of the attached light-receiving module as seen from the side of the light-emitting module.

FIG. 12 is a schematic diagram for explaining adjustment of the attached light-receiving module 32 as seen from a direction perpendicular to the direction of the light beam LB, and FIG. 13 is a schematic diagram for explaining adjustment of the attached light-receiving module 32 as seen from the side of the light-emitting module 30.

An upper protruded portion 45*f* and a lower receiving portion 45*g* that are included in the light-receiving element holder 45 and exposed through the reception-side module cover 33 are sandwiched by a perpendicular moving jig 52 in parallel to the reception-side holder shaft 45*c*, and the reception-side holder shaft 45*c* and the guide protrusion 45*e* are inserted into the reception-side positioning hole 35 and the guide groove 39, respectively, so that the light-receiving element holder 45 can be slid for adjustment in the perpendicular direction. As described above, after the light-receiving element holder 45 is slid for adjustment, the light-receiving module 32 is fixed to the base member 28 with the fastening members 49. A light guiding cover is indicated with the reference numeral 53 as shown in FIGS. 4, and 7 to 13.

Figure 14:
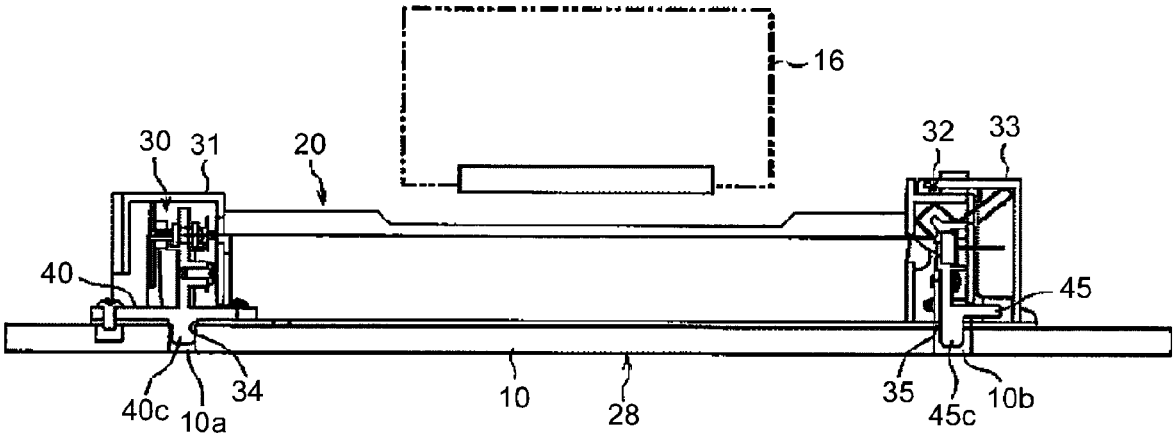
FIG. 14 is a schematic diagram of the ink-droplet detecting unit attached to a casing shown in FIG. 1 such that the position of the ink-droplet detecting unit is set at an emission-side positioning point and a reception-side positioning point.

FIG. 14 is a schematic diagram of the ink-droplet detecting unit 20 attached to the casing 10 such that the position of the ink-droplet detecting unit 20 is set at an emission-side positioning point and a reception-side positioning point.

The light-emitting module 30 and the light-receiving module 32 are attached to the base member 28 and covered with the emission-side module cover 31 and the reception-side module cover 33. After the angle adjustment is performed, the emission-side holder shaft 40*c* inserted into the emission-side positioning hole 34 and the reception-side holder shaft 45*c* inserted into the reception-side positioning hole 35 are fit into positioning holes 10*a* and 10*b* arranged on the casing 10 whereby the ink-droplet detecting unit 20 is attached to the casing 10. The positioning hole 10*a* has a circular shape such that the emission-side holder shaft 40*c* can be correctly fit into the positioning hole 10*a*, and the positioning hole 10*b* has a long oval shape extending toward the positioning hole 10*a*.

As described above, according to one aspect of the present invention, it is possible to adjust an angle of a light axis in an easy manner before an ink-droplet detecting unit is attached to a main body of an inkjet recording apparatus.

Furthermore, according to another aspect of the present invention, it is possible to improve assembly accuracy as well as detection performance.

Moreover, according to still another aspect of the present invention, it is possible to obtain parallelism between the light axis and a row of nozzle holes included in an ink-droplet spray head in an easy manner.

Furthermore, according to still another aspect of the present invention, it is possible to receive an amount of light for detection in an effective manner.

Moreover, according to still another aspect of the present invention, it is possible to rotate a light-emitting element holder for adjustment in an accurate and easy manner.

Furthermore, according to still another aspect of the present invention, it is possible to slide a light-receiving element holder for adjustment in an accurate and easy manner.

Moreover, according to still another aspect of the present invention, it is possible to form a guide surface in a simple and easy manner without increasing the number of components.

Furthermore, according to still another aspect of the present invention, it is possible to move the light-receiving element holder in parallel to a shaft center of a reception-side holder shaft in an accurate manner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An inkjet recording apparatus comprising:

an ink-droplet spray head configured to spray an ink droplet; and an ink-droplet detecting unit configured to detect a spray state of the ink droplet, the ink-droplet detecting unit including a light-emitting element configured to emit a light, a light-emitting element holder that holds the light-emitting element, a light-receiving element configured to receive the light emitted from the light-emitting element, a light-receiving element holder that holds the light-receiving element, and a base member on which the light-emitting element holder and the light-receiving element holder are mounted at an emission-side positioning point and a reception-side positioning point, respectively, wherein the light-emitting element holder is adjustably attached to the base member such that the light-emitting element holder is horizontally rotatable around the emission-side positioning point, wherein the light-receiving element holder is adjustably attached to the base member in a slidable and adjustable manner such that the light-receiving element holder is slidable in a direction perpendicular to an upper surface of the base member, and wherein the ink-droplet detecting unit is attached to a main body of the inkjet recording apparatus.

2. The inkjet recording apparatus according to claim 1, wherein:

the light-emitting element holder includes an emission-side holder shaft that is inserted into an emission-side positioning hole formed at the emission-side positioning point, and the light-receiving element holder includes a reception-side holder shaft that is inserted into a reception-side positioning hole formed at the reception-side positioning point.

3. The inkjet recording apparatus according to claim 2, wherein:

an emission point of the light-emitting element is arranged on a position corresponding to a shaft center axis of the emission-side holder shaft, and a shaft center axis of the reception-side holder shaft is arranged in parallel to a light-receiving surface of the light-receiving element.

4. The inkjet recording apparatus according to claim 3, wherein the light-emitting element holder includes a jig engagement portion that is engaged with a part of a jig by which the light-emitting element holder is rotatable for an alignment around the emission-side holder shaft.

5. The inkjet recording apparatus according to claim 3, wherein:

the light-receiving element holder includes a slide surface arranged in parallel to the shaft center axis of the reception-side holder shaft, and the base member includes a guide surface that is configured to be brought into contact with the slide surface such that the light-receiving element holder is guidable by the guide surface.

6. The inkjet recording apparatus according to claim 5, wherein the guide surface is formed as a cut and folded portion of the base member.

7. The inkjet recording apparatus according to claim 5, wherein one of the slide surface and the guide surface includes a guide protrusion and another of the slide surface and the guide surface includes a guide groove into which the guide protrusion is fitted to guide the light-receiving element holder.

8. An inkjet recording apparatus comprising:

an ink-droplet spray head configured to spray an ink droplet; and an ink-droplet detecting unit configured to detect a spray state of the ink droplet, the ink-droplet detecting unit including a light-emitting element configured to emit a light, a light-emitting element holder that holds the light-emitting element, a light-receiving element configured to receive the light emitted from the light-emitting element, a light-receiving element holder that holds the light-receiving element, and a base member on which the light-emitting element holder and the light-receiving element holder are mounted at an emission-side positioning point and a reception-side positioning point, respectively, wherein the light-emitting element holder is adjustably attached to the base member such that the light-emitting element holder is rotatable about an axis that is perpendicular to an upper surface of the base member and that runs through the emission-side positioning point, wherein the light-receiving element holder is adjustably attached to the base member in a slidable and adjustable manner such that the light-receiving element holder is slidable in a direction perpendicular to the upper surface of the base member, and wherein the ink-droplet detecting unit is attached to a main body of the inkjet recording apparatus.

* * * * *